US009627164B2

(12) United States Patent
Robinson et al.

(10) Patent No.: US 9,627,164 B2
(45) Date of Patent: Apr. 18, 2017

(54) CIRCUIT BREAKERS INCLUDING SHORT WIRED PIGTAIL, BASE PANS, INSTALLATION METHODS AND ASSEMBLIES THEREOF

(71) Applicant: Siemens Industry, Inc., Alpharetta, GA (US)

(72) Inventors: Kristopher Scott Robinson, Atlanta, GA (US); Brian J. Rusch, Suwanee, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 51 days.

(21) Appl. No.: 14/747,227

(22) Filed: Jun. 23, 2015

(65) Prior Publication Data

US 2016/0314927 A1 Oct. 27, 2016

Related U.S. Application Data

(60) Provisional application No. 62/151,634, filed on Apr. 23, 2015.

(51) Int. Cl.

| | |
|---|---|
| ***H01H 19/58*** | (2006.01) |
| ***H01H 71/08*** | (2006.01) |
| ***H01H 71/00*** | (2006.01) |
| *H01H 71/10* | (2006.01) |

(52) U.S. Cl.

CPC ..... *H01H 71/082* (2013.01); *H01H 71/002* (2013.01); *H01H 19/58* (2013.01); *H01H 71/08* (2013.01); *H01H 71/1009* (2013.01)

(58) Field of Classification Search

CPC ..... Y10T 29/49117; H01H 71/0271; H01H 19/58; H01H 71/08; H01H 71/1009; H01H 71/082; H01R 25/006; H01R 25/162; H01R 25/164

USPC ..... 361/115, 637, 673, 600, 614, 648; 439/209, 214, 345; 200/11 R, 51 R, 337, 200/401, 293

See application file for complete search history.

(56) References Cited

U.S. PATENT DOCUMENTS

| | | | | |
|---|---|---|---|---|
| 5,973,914 | A * | 10/1999 | Rose | H02B 1/056 200/50.4 |
| 2012/0326518 | A1* | 12/2012 | Rusch | H02J 7/34 307/80 |
| 2013/0271257 | A1 | 10/2013 | Yang | |
| 2014/0321005 | A1* | 10/2014 | Samuelson | H02H 3/16 361/42 |

(Continued)

*Primary Examiner* — Edwin A. Leon
*Assistant Examiner* — Ahmed Saeed

(57) ABSTRACT

A circuit breaker including a housing and a short wired pigtail exiting the housing. The short wired pigtail has a factory length from a point of exit from the housing to a terminal end of less than about 16 cm, and can include pre-configured bends, and may be pre-stripped. In another aspect, a base pan for mounting a circuit breaker is provided. Base pan includes a plurality of busses, and an insulating base portion receiving the busses, the base pan configured to receive a circuit breaker thereon, the insulating base portion including a pigtail guide channel configured to direct a short wired pigtail towards a neutral bar socket as the circuit breaker is mounted to the insulating base portion. Circuit breakers, base pan assemblies, and methods of installing circuit breakers are provided, as are other aspects.

19 Claims, 10 Drawing Sheets

(56) References Cited

U.S. PATENT DOCUMENTS

| | | | | |
|---|---|---|---|---|
| 2015/0049420 | A1* | 2/2015 | DeBoer | H01H 9/54<br>361/631 |
| 2015/0062769 | A1* | 3/2015 | Cortes Rico | H02H 3/08<br>361/93.1 |
| 2015/0068881 | A1* | 3/2015 | Watford | H01H 71/1009<br>200/5 R |

* cited by examiner

*"Prior Art"*

"Enlarged View"

"Enlarged View"

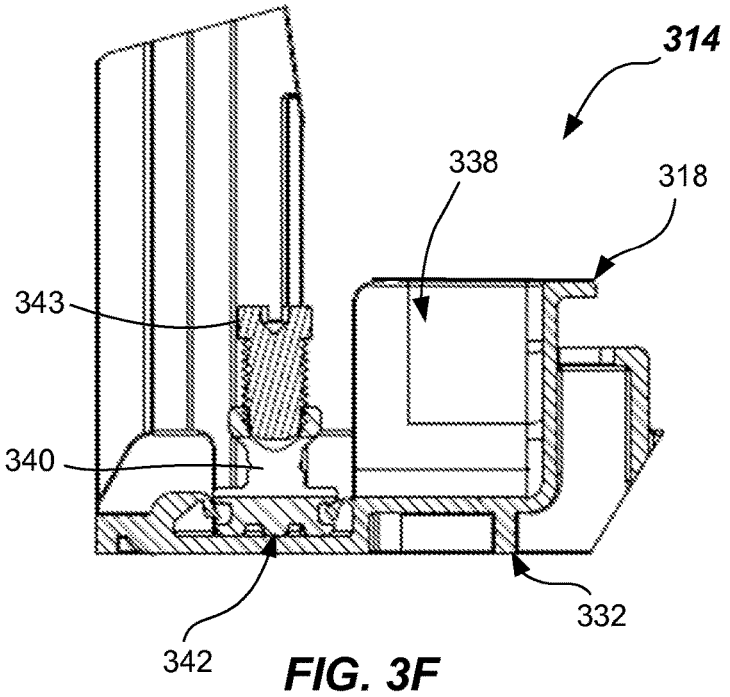
FIG. 3F
FIG. 4
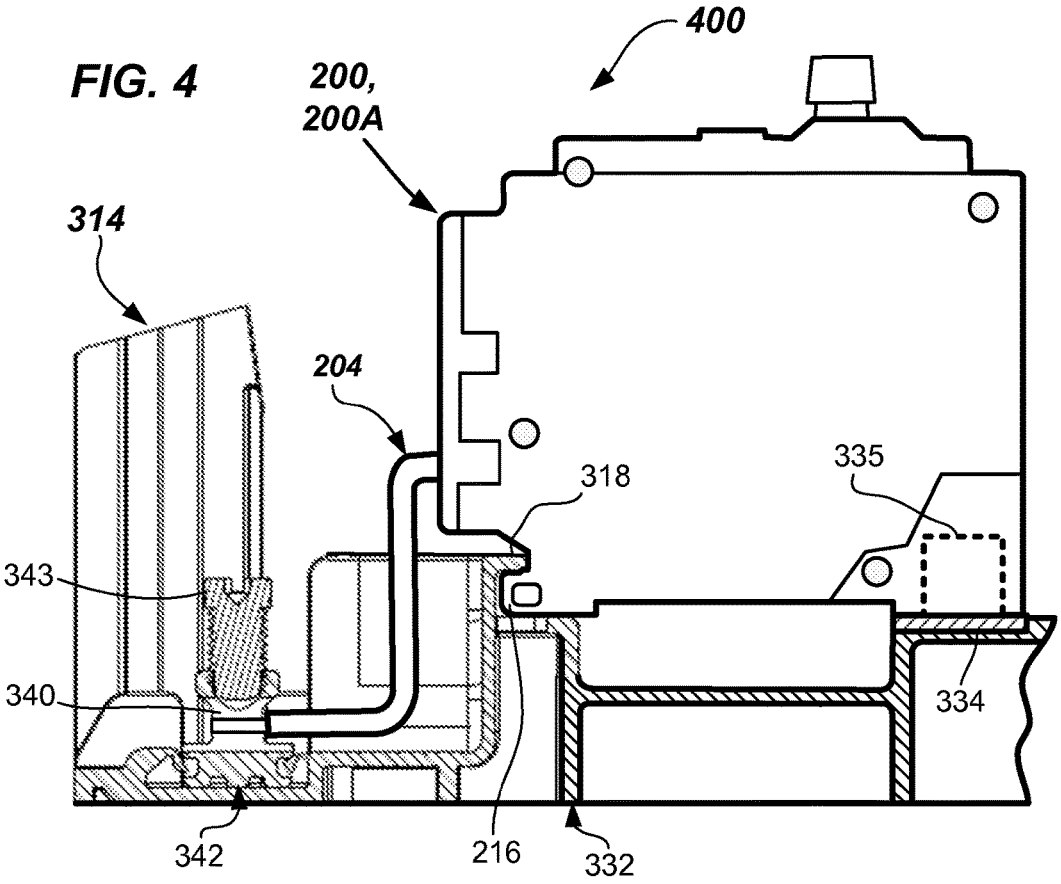

CIRCUIT BREAKERS INCLUDING SHORT WIRED PIGTAIL, BASE PANS, INSTALLATION METHODS AND ASSEMBLIES THEREOF

RELATED APPLICATION

This application claims priority to U.S. Provisional Patent Application Ser. No. 62/151,634 filed on Apr. 23, 2015, and entitled "LOAD CENTER WITH IMPROVED FEATURES FOR ELECTRONIC BREAKER INSTALLATION," the disclosure of which is hereby incorporated by reference in its entirety herein.

FIELD

The present invention relates generally to circuit breakers, and more particularly to installation of circuit breakers and connection of neutral wire conductors thereof.

BACKGROUND

In general, a circuit breaker operates to engage and disengage a selected branch electrical circuit from an electrical power supply. The circuit breaker provides current interruption thereby providing protection to the electrical circuit from continuous over-current conditions and high-current transients due, for example, to electrical short circuits. Such circuit breakers operate by separating a pair of internal electrical contacts contained within a housing of the circuit breaker. Typically, one electrical contact is stationary while the other is movable and may be coupled to a moveable contact arm.

In some embodiments, so-called "electronic circuit breakers" may include a neutral conductor pigtail used to connect to a neutral (e.g., to a neutral bar) in a load center. Arc faults Circuit Breakers (AFCIs) include such a wound neutral conductor pigtail, for example.

Today, AFCI breakers are shipped with long curled wire neutral conductors. The industry term used to describe the wired conductors is "pig-tail". The pig-tail to neutral connection is made for AFCI's to detect line-to-neutral or line-to-ground arc faults. The pig-tail to neutral bar connection is accomplished by use of a screw driven to a specified torque.

In existing electronic circuit breakers 100 as shown in FIG. 1, the wound wire pigtail 104 from the exit from the housing 102 may have a total length of about 30 cm or more. Prior to installation, the installer straightens the pigtail, measures the length of neutral pigtail needed for the particular installation, cuts the pigtail to the desired length, and then strips the end thereof. The installer must then further bend and arrange the neutral wire to make a connection to the neutral bar socket of a neutral bar. As should be apparent, such installation is very time consuming and therefore expensive.

In another approach, the connection to the neutral bar may be made by using a "plug-on" connection on the line side of the circuit breaker to a neutral bar or strap. However, although the plug-on connection is less labor intensive than using a coiled pig-tail to make the neutral connection, the plug-on connection may suffer from a drawback that sometimes it may become detached from the neutral rail.

Thus, electronic circuit breaker designs and assemblies configured to provide lower installation costs and/or installation time are desired.

SUMMARY

According to a first aspect, a circuit breaker is provided. The circuit breaker includes housing, and a short wired pigtail exiting the housing, the short wired pigtail having a factory length from a point of exit from the housing to a terminal end of less than about 16 cm.

In accordance with another aspect, a base pan for mounting a circuit breaker is provided. The base pan includes a plurality of busses, and an insulating base portion receiving the busses, the base pan configured to receive a circuit breaker thereon, the insulating base portion including a pigtail guide channel configured to direct a short wired pigtail towards a neutral bar socket as the circuit breaker is mounted to the insulating base portion According to another aspect, a base pan and circuit breaker assembly is provided. The base pan and circuit breaker assembly includes a circuit breaker including a housing, and a short wired pigtail exiting the housing, the short wired pigtail having a factory length from a point of exit from the housing to a terminal end of less than about 16 cm, and a base pan, including a plurality of busses, a neutral bar including a neutral bar socket, and an insulating base portion receiving the busses, the base pan configured to receive the circuit breaker, the insulating base portion including a pigtail guide channel adapted to direct the short wired pigtail towards a neutral bar socket as the circuit breaker is mounted to the insulating base portion.

In accordance with another aspect, a method of installing a circuit breaker is provided. The method includes providing a base pan including a plurality of busses, a neutral bar including a neutral socket, and an insulating base portion, the base pan configured to receive the circuit breaker, the insulating base portion including a pigtail guide channel, providing a circuit breaker including a housing, and a short wired pigtail exiting the housing, the short wired pigtail having a factory length from a point of exit from the housing to a terminal end of less than about 16 cm, and directing the short wired pigtail towards the neutral socket within the pigtail guide channel as the circuit breaker is mounted to the insulating base portion.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

BRIEF DESCRIPTION OF DRAWINGS

The drawings, described below, are for illustrative purposes only and are not necessarily drawn to scale. Like reference numerals used in the drawings identify similar or identical elements throughout the several views. The drawings are not intended to limit the scope of the invention in any way.

FIG. 3F illustrates an enlarged cross-sectioned side view of a portion of base pan of FIG. 3A taken along section lines 3F-3F according to one or more embodiments.

FIG. 4 illustrates a circuit breaker and base pan assembly according to one or more embodiments.

DESCRIPTION

Reference will now be made in detail to the example embodiments of this disclosure, which are illustrated in the accompanying drawings.

To lower the cost of manufacture and lower installation costs for installing circuit breakers, the inventors herein have invented a quick-connect circuit breaker and base pan assembly. The quick-connect circuit breaker reduces the labor involved with making the neutral bar connection, while utilizing a tried-and-true screw and wire connection. During installation, a circuit breaker with a short wired pigtail that is pre-configured from the factory may be removed from the packaging, and installed to the base pan without having to measure and cut of the short wired pigtail. This dramatically saves on the installation time by reducing the number of steps it takes to install a circuit breaker into a load center. Further, the compact configuration allows more room in the trough for routing of other wires. Moreover, the shorter length of the pigtail saves on material costs.

One or more embodiments of the invention are directed at a circuit breaker (e.g., an electronic circuit breaker) including a short wired pigtail having a total outside length of less than about 16 cm. The short wired pigtail may be bent from the factory with an L-bend or other factory bend. In some embodiments, the short wired pigtail may be pre-bent to an installed configuration, such that the installer may remove simply the circuit breaker from packaging and immediately install the circuit breaker to the base pan without further bending and/or cutting. In one or more embodiments, the short wired pigtail may be pre-stripped to remove an end portion to be received in the neutral bar socket of a neutral bar.

In other embodiments, a base pan configured for mounting a circuit breaker with a short wired pigtail is provided. The base pan includes an insulating base portion including one or more pigtail guide channels. The pigtail guide channel is configured to orient and/or direct the short wired pigtail towards a neutral bar socket of a neutral bar as the circuit breaker is mounted to the insulating base portion.

One or more embodiments of the invention may be applied to one-pole or two-pole electronic residential circuit breakers. Such circuit breakers may include ratings of between about 15 A to 60 A (including ratings of 15 A, 20 A, 30 A, 40 A, 60 A), for example. Furthermore, embodiments of the invention may be applied to a single-pole or two-pole arc fault circuit interrupters (AFCIs), combination arc fault circuit interrupters (CAFCIs), and/or ground fault circuit interrupters (GFCIs) constructions, or any other circuit breaker including a wired pigtail.

These and other embodiments of circuit breakers, base pans, and circuit breaker and base pan assemblies, as well as installation methods are described below with reference to FIGS. 2A-5 herein.

Figure 1:
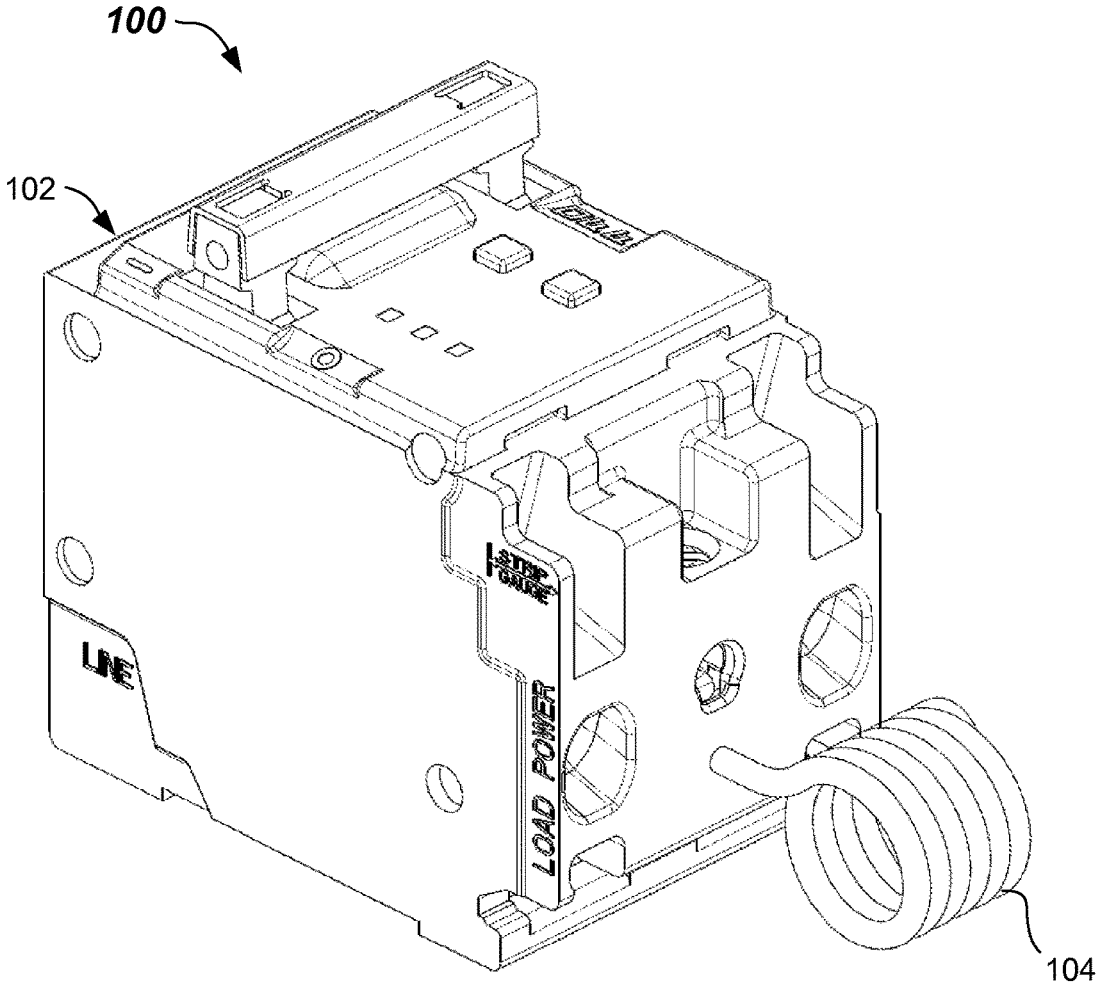
FIG. 1 illustrates a load-side perspective view of a circuit breaker including a factory coiled neutral pigtail according to the "Prior Art."
Figure 2A:
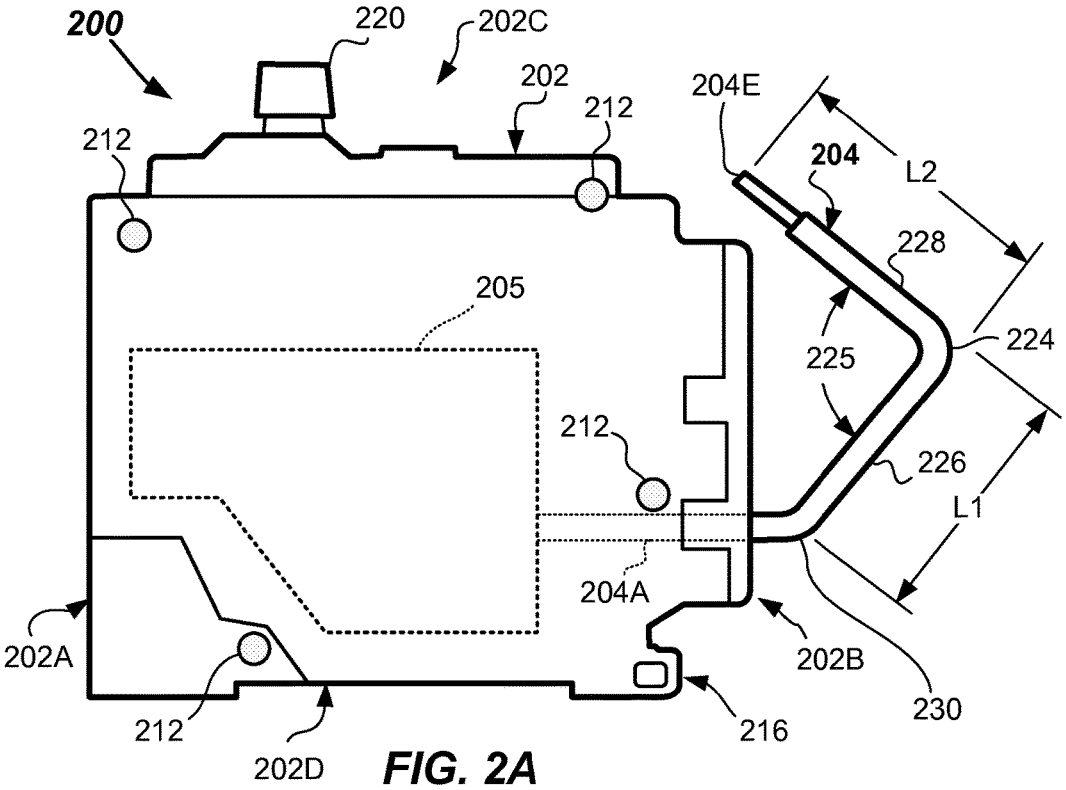
FIG. 2A illustrates a side plan view of a circuit breaker including a factory-configured short wired pigtail according to one or more embodiments.
Figure 2B:
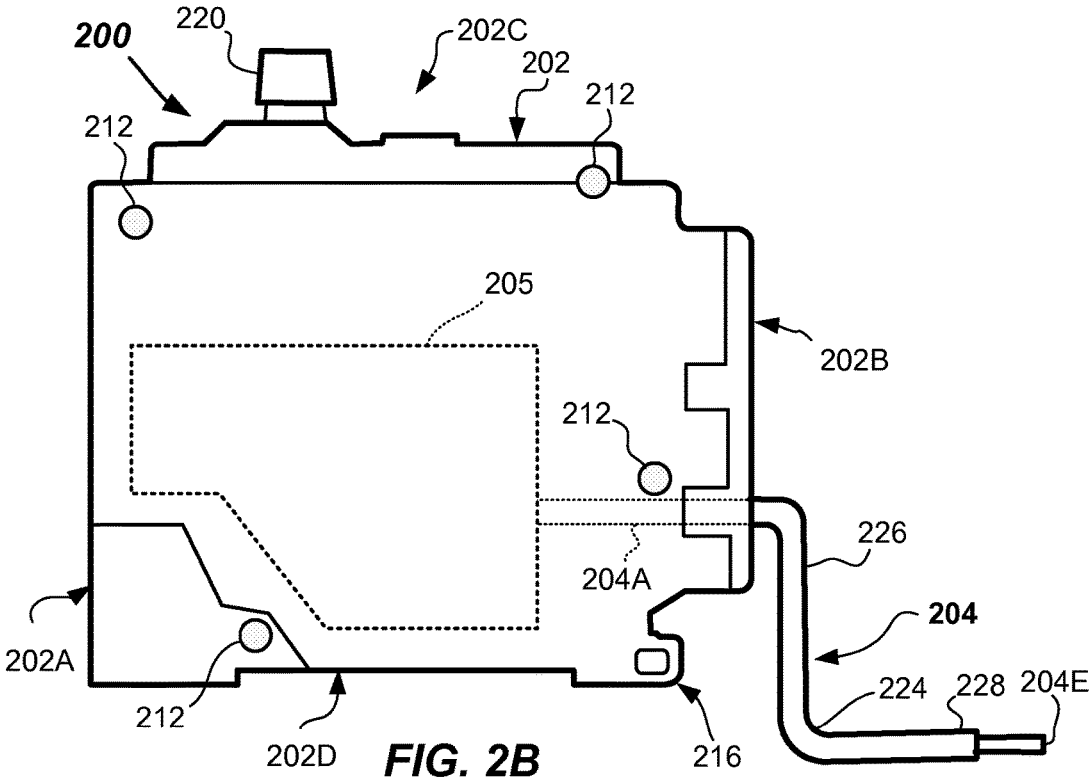
FIG. 2B illustrates a side plan view of a circuit breaker including another factory-configured short wired pigtail according to one or more embodiments.

Referring now to FIGS. 2A-2B, a circuit breaker 200 including a short wired pigtail 204 is provided in accordance with one or more embodiments of the invention. Circuit breaker 200 includes a housing 202, which may be molded case housing made from a suitable plastic material, for example. The material may be a thermoset material, such as a glass-filled polyester, or a thermoplastic material such as a Nylon material (e.g., Nylon 6), for example. Other suitable insulating housing materials may be used.

Figure 2C:
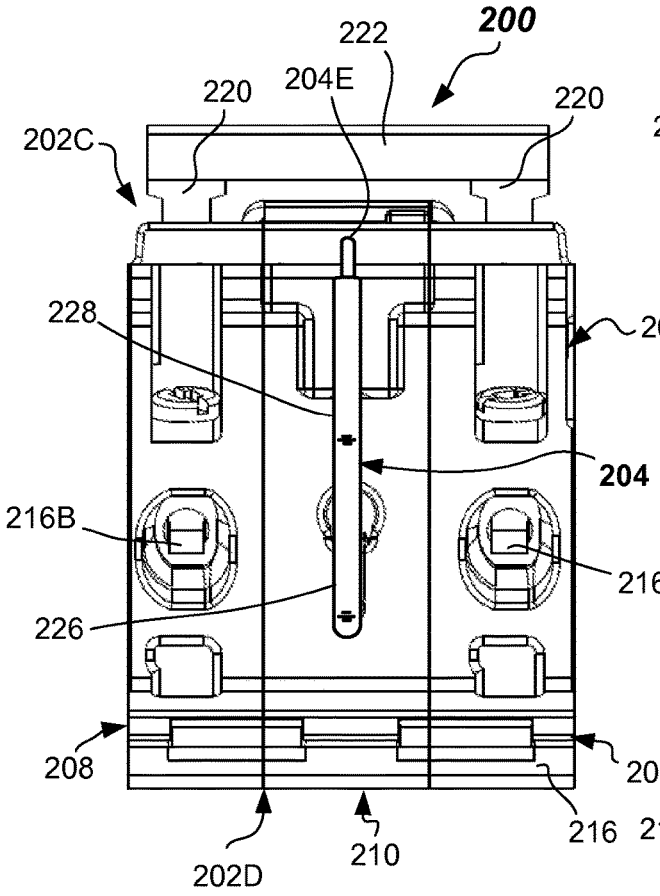
FIG. 2C illustrates a front plan view of a two-pole electronic circuit breaker including a factory-configured short wired pigtail according to one or more embodiments.
Figure 2D:
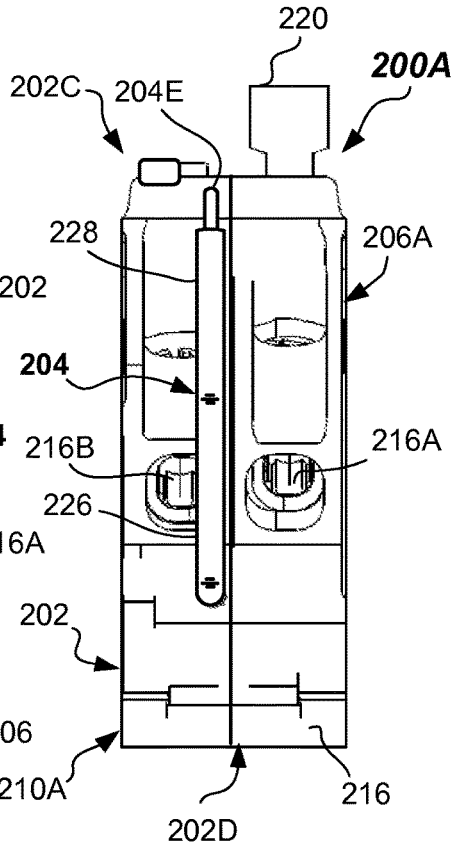
FIG. 2D illustrates a front plan view of a one-pole electronic circuit breaker including a factory-configured short wired pigtail according to one or more embodiments.

The circuit breaker 200 and housing 202 may be made up of any number of interconnecting housing module sections. For example, as shown in FIGS. 2C and 2D, multiple module sections may be connected together to form the circuit breaker 200. In the depicted embodiments, the circuit breaker 200 may include one or more mechanical pole modules and an electronic pole module as shown in FIGS. 2C and 2D. As shown in FIG. 2C, a two-pole embodiment of circuit breaker 200 is provided. Circuit breaker 200 includes a first mechanical module 206, second mechanical module 208, and an electronic module 210. The electronic module 210 may be positioned (e.g., sandwiched) between the first mechanical module 206, and the second mechanical module 208. The modules 206, 208, 210 may be fastened together by suitable fasteners 212, such as rivets.

As shown in FIG. 2D, a one-pole embodiment of circuit breaker 200A is provided. Circuit breaker 200A includes a mechanical module 206A and an electronic module 210A.

Figure 2E:
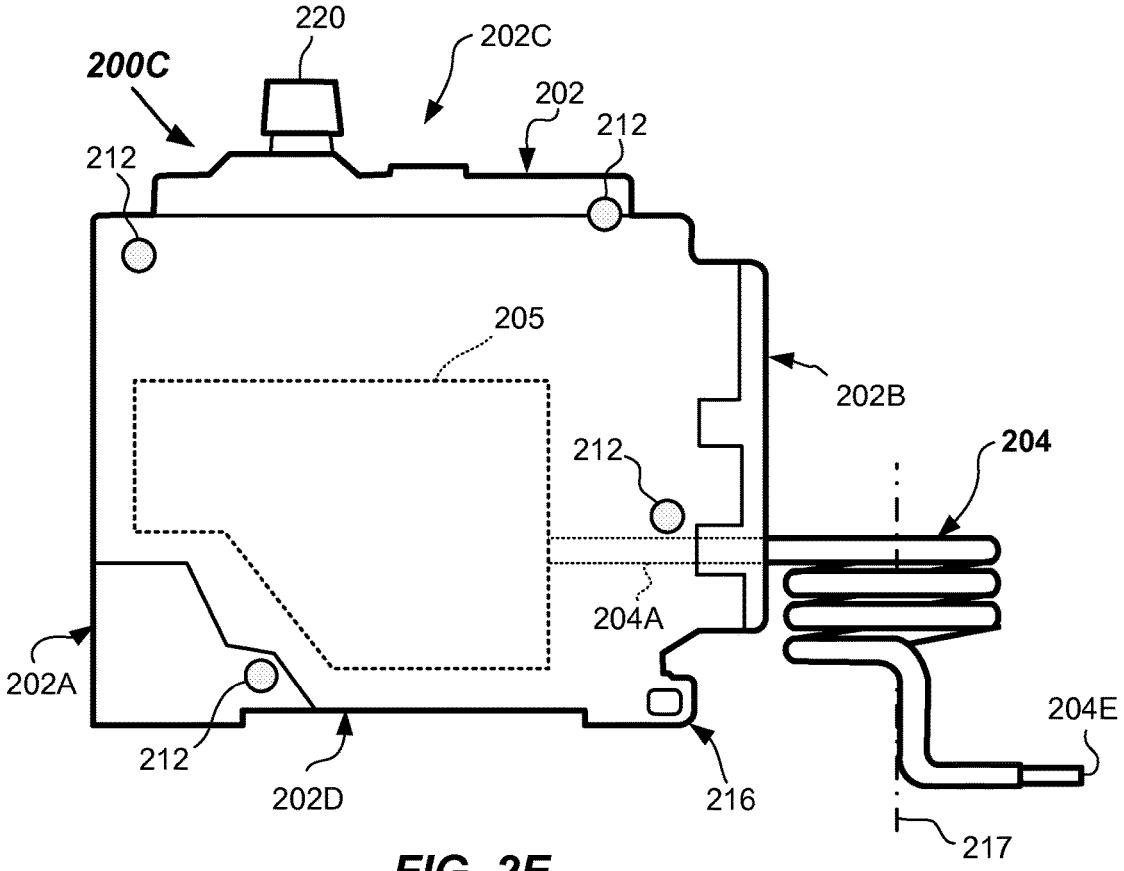
FIG. 2E illustrates a side plan view of a circuit breaker including another factory-configured short wired pigtail according to one or more embodiments.
Figure 2F:
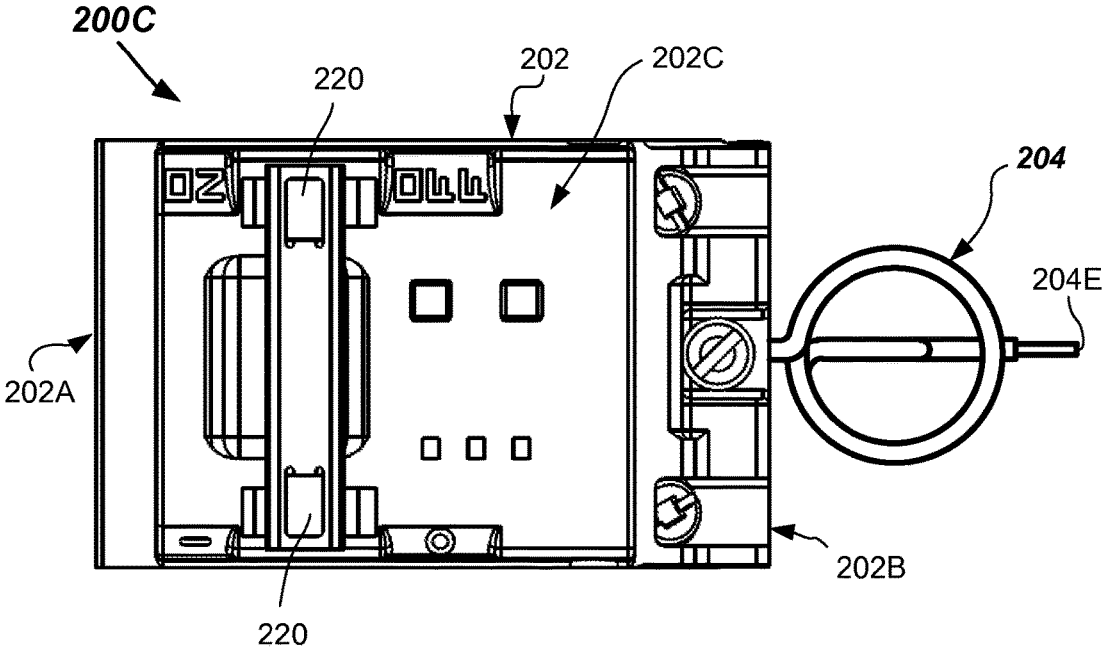
FIG. 2F illustrates a front plan view of a circuit breaker including another factory-configured short wired pigtail according to one or more embodiments.

FIGS. 2E and 2F illustrate another embodiment of a circuit breaker 200C. Circuit breaker 200C includes a short wired pigtail 204 as before. However, in this configuration, the short wired pigtail 204 is wound with an axial wind axis 217 extending along the height of the circuit breaker 200C, as shown, from top 202C to bottom 202D. This configuration is easy for the installer to install the terminal end 202E of the short wired pigtail 204 into the neutral bar socket. Orientation of the coil in this fashion makes it easy to move the terminal end 204E slightly to the height dimension to align with the neutral bar socket. As shown in FIG. 2F, the short wired pigtail 204 may be pre-bent from the factory to a position where the terminal end 204E is substantially aligned with the neutral bar socket when installed.

In each case, the housings 102 may be made up of, and include, an arrangement of internal and external side covers, which are adapted to contain and/or retain the various working internal components of the circuit breakers 200, 200A, which are not otherwise described herein and are conventional.

The circuit breakers 200, 200A include a line side 202A, a load side 202B, a top 202C, and a bottom 202D. Bottom 202D is configured and adapted to interface with a base pan 314 (FIGS. 3A-4), or the like. Line side 202A may be configured and adapted to abut an end of another circuit breaker, as installed. Load side 202B may include a load terminal or terminals adapted to couple to branch circuits. Line side 202A may include a line terminal or terminals (e.g., a c-clip or clips) adapted to contact line conductors (e.g., stabs 335—FIG. 3A-3C) on busses of the base pan 314 or the like. Load side 202B may include load terminals 216A, 216B as shown in FIG. 2C.

Load side 202B may further include the short wired pigtail 204 functioning as a neutral conductor. Load side 202B may also include a connection feature 216, such as a tab, which may interface with a complementary feature 318, such as a hook on a base pan 314 as shown in FIG. 4. The circuit breakers 200, 200A may include other conventional items, such as handles 220 on each mechanical module 206, 208 and possibly a handle interconnector 222.

Now referring to FIG. 2A, the short wired pigtail 204 of the first embodiment of a circuit breaker 200, 200A will now be described in detail. The short wired pigtail 204 may exit from the housing 202 at a point proximate to the bottom 202D through a hole in the housing 202, for example. Other exit locations may be used. The short wired pigtail 204 has a factory length from the point of exit from the housing 202 to a terminal end 204E of less than about 16 cm. "Factory length" as defined herein means a length of the short wired pigtail 204, as measured along a center of a conductor making up the short wired pigtail 204 as the circuit breakers 200, 200A leave the manufacturing facility, i.e., the length as manufactured. An unmeasured wire portion 204A (shown dotted) may reside inside of the housing 202 and may connect to internal circuitry 205 (shown dotted) of the circuit breaker 200, 200A. In one or more embodiments, the factory length of between about 5 cm and about 16 cm or even between about 10 cm and about 16 cm may be used. Short wired pigtail 204 may be between an 8 gauge and a 12 gauge of copper wire having an insulating coating thereon.

Short wired pigtail 204 may, in some embodiments, come in a pre-stripped configuration from the factory, where the insulating coating on the short wired pigtail 204 is removed a defined distance back from the terminal end 204E. The defined distance may be between about 1 cm and about 3 cm from the terminal end 204E, for example. This readies the terminal end to be accepted into the neutral bar socket (340—FIG. 40 without the installer having to take time to strip the insulating coating.

In one or more embodiments, as shown in FIG. 2A, the short wired pigtail 204 may include an L-bend 224 provided on the short wired pigtail 204 from the factory. The L-bend may be bent at a bend angle 225 of between about 60° to about 120°, and about 90° in some embodiments, as measured between a first segment 226 and a second segment 228 of the short wired pigtail 204. The first segment 226 may have a length L1 of between about 3 cm and about 10 cm. The second segment 226 may have a length L2 of between about 3 cm and about 10 cm.

In one or more embodiments, the short wired pigtail 204 may include a starting bend 230 that bends upwardly towards the top 202C of the circuit breaker 200 as the short wired pigtail 204 exits the housing 202. The starting bend 230 may be factory provided in addition to the L-Bend 224 so that the circuit breaker 200 can be housed/sold in a smaller package. In use, the installer, after removing the circuit breaker 200 from the packaging in the configuration shown in FIG. 2A, will bend the short wired pigtail 204 at the starting bend 230 until the configuration looks like or similar to that shown in FIG. 2B.

Optionally, the circuit breaker 200 can include a short wired pigtail 204 having the configuration shown in FIG. 2B from the factory, so that the installer can simply take the circuit breaker out of the packaging and install it to the base pan 314 (FIGS. 3A-4) without having to measure, cut, strip, or bend the short wired pigtail 204. As should be apparent, either configuration will have dramatically reduced installation time and costs. Moreover, the short wired pigtail takes up much less space in the trough of the panel box and thus leaves more space for routing of other wires therein.

In another aspect according to one or more embodiments, a base pan 314 that is configured for mounting one or more circuit breakers 200, 200A is provided. Base pan 314 includes an insulating base portion 332 and a plurality of busses 334, 336 received thereon. Busses 334, 336 may be A and B phase busses and may snap into position on the insulating base portion 332 using snap-fit features, or may otherwise be molded to or fastened the insulating base portion 332. Busses 334, 336 may be constructed as conductive metal bars (e.g., copper or copper alloy, or aluminum or aluminum alloys) and may include multiple stabs 335 incrementally arranged along their length to allow for electrical connection to the line side 202A of the circuit breakers 200, 200A. Stabs 335 may be arranged at spacing intervals of about every 2.5 cm along the length of the busses 334, 336, for example. Other spacing may be used.

Insulating base portion 332 may be a single molded piece, or made up of multiple interfacing pieces. Insulating base portion 332 may be made of a suitable electrically insulating material, such as a plastic material, for example. Base pan 314 is configured to receive one or more circuit breakers 200, 200A thereon. Insulating base portion 332 may be molded and may include one or more attachment features 337 for attaching the base pan 314 to an enclosure, such as a panel box (not shown).

Insulating base portion 332 may include one or more pigtail guide channels 338 (a few labeled), which may be molded or otherwise formed therein. The one or more pigtail guide channels 338 are configured and adapted to orient/direct the short wired pigtail 204 of the circuit breaker 200 towards a neutral bar socket 340 of a neutral bar 342 as the circuit breaker 200 is being mounted to the insulating base portion 332. The configuration of the pigtail guide channels 338 may include any configuration that guides and directs the trajectory of the short wired pigtail 204 during installation of the circuit breaker 200.

The insulating base portion 332 may include one or more neutral bars 342 mounted thereto. Neutral bar 342 may be a conductive material such as copper or aluminum or alloys thereof. Each neutral bar 342 may have any number of neutral bar sockets 340 formed therein, such as between about 10 and 40, for example. Other numbers of neutral bar sockets 340 may be used. Each neutral bar socket 340 may include an associated screw 343 that can be turned to secure the stripped end of the short wired pigtail 204 therein. The neutral bar 342 may be retained in the insulating base portion 332 by snap fit portions of the insulating base portion 332 as shown in FIG. 3F. Neutral bar 342 may be otherwise mounted or fastened to the insulating base portion 332.

Figure 3A:
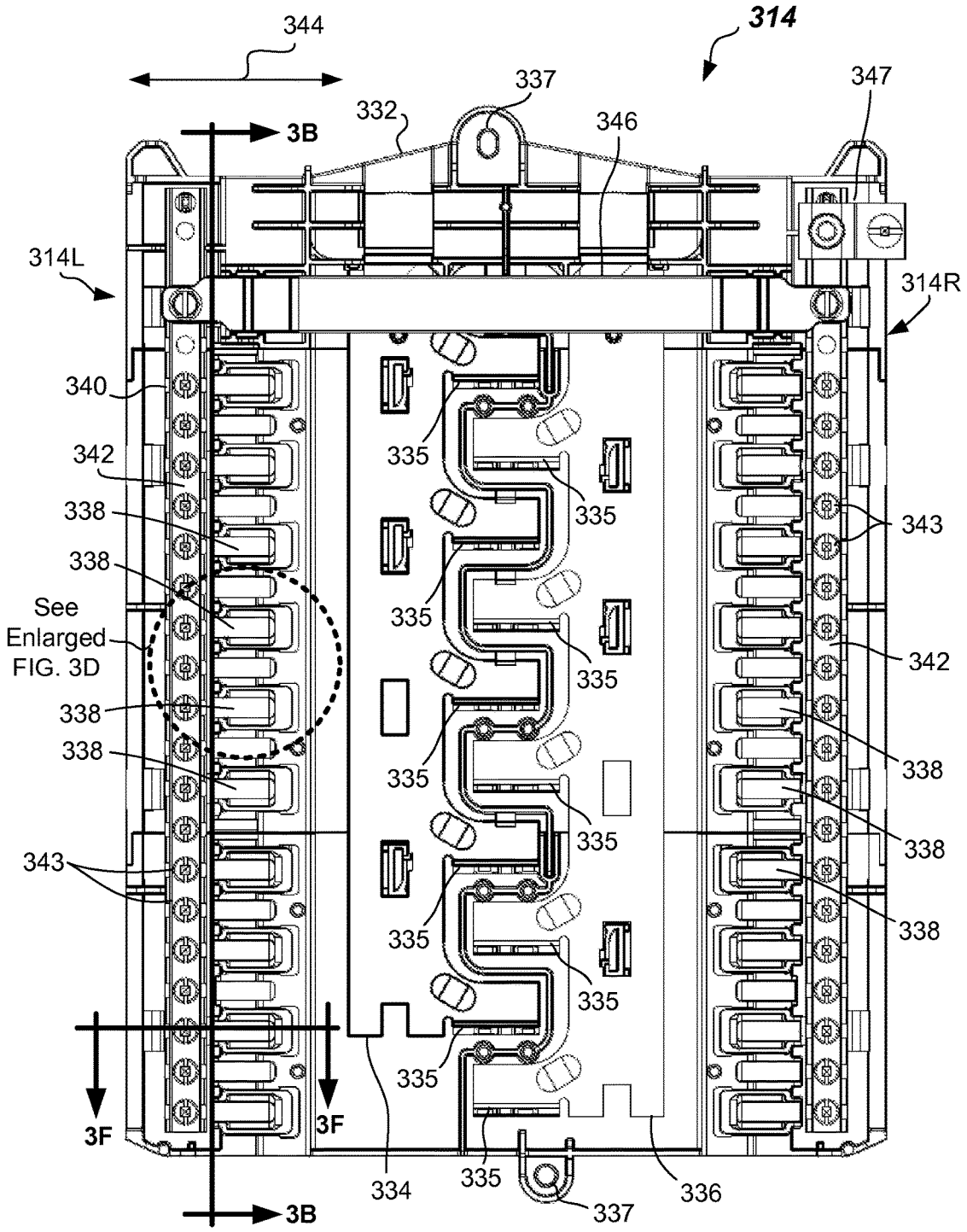
FIG. 3A illustrates a front plan view of base pan onto which one or more circuit breakers including short wired pigtails may be mounted, the base pan including multiple pigtail guide channels according to one or more embodiments.
Figure 3B:
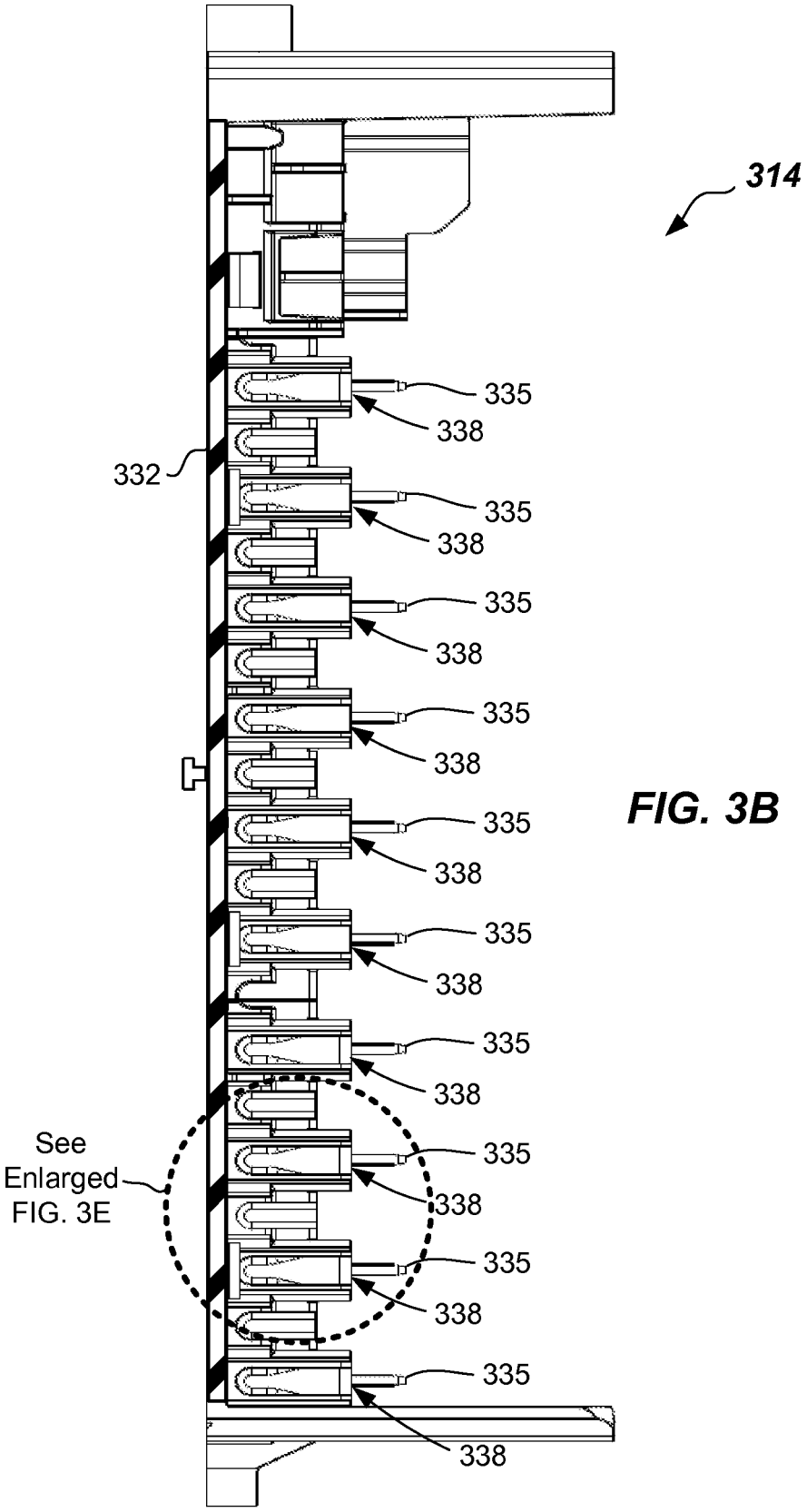
FIG. 3B illustrates a cross-sectioned side view of a base pan of FIG. 3A taken along section lines 3B-3B according to one or more embodiments.
Figure 3C:
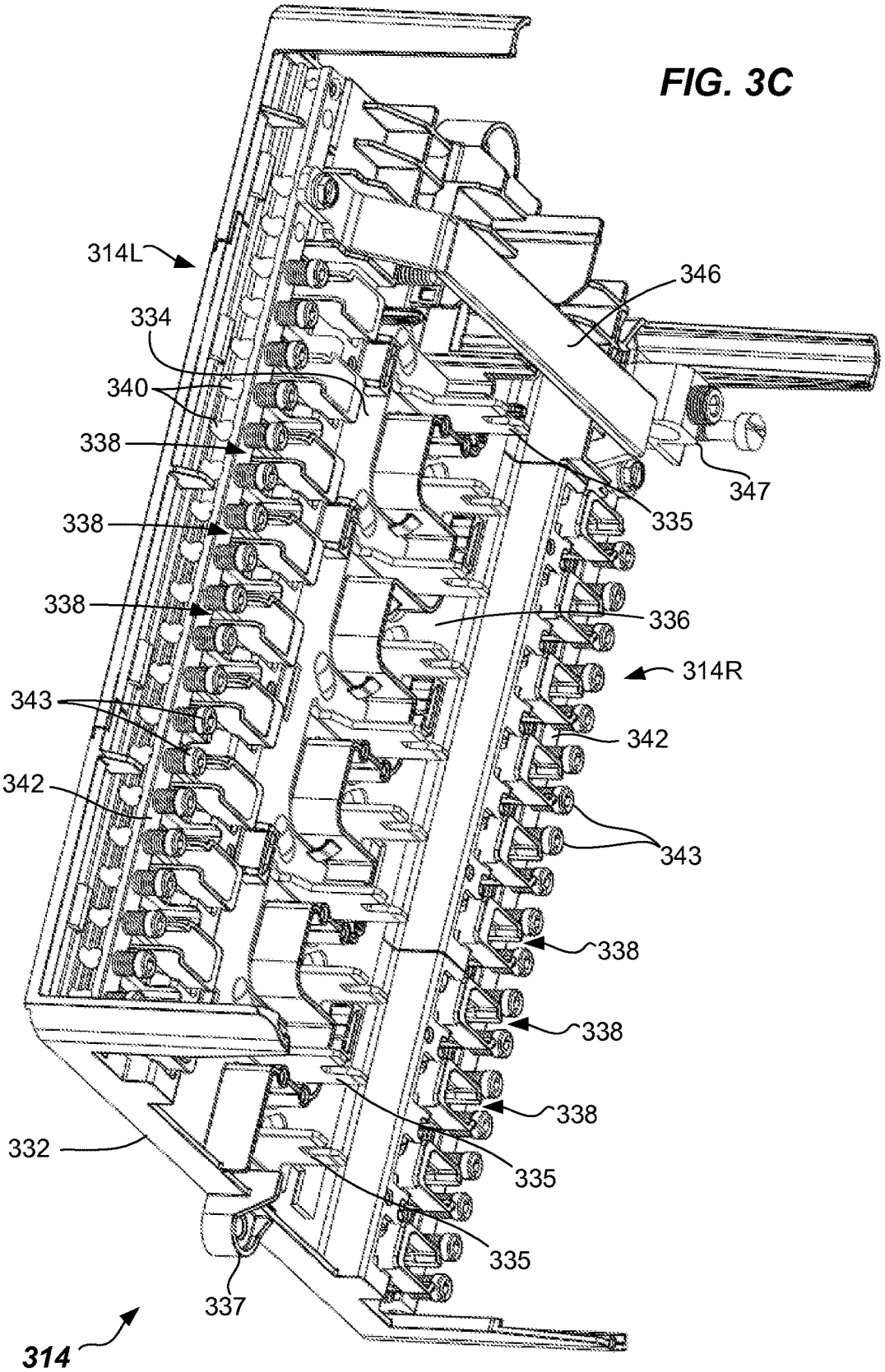
FIG. 3C illustrates an isometric view of a base pan according to one or more embodiments.

As shown in FIG. 3A through FIG. 3C, there may be a neutral bar 342 mounted on both sides of the insulating base portion 332. A neutral cross tie 346, such as a conductive strap of copper, aluminum or alloy, may electrically connect and tie the neutral bars 342 together. Neutral connector 347 may allow for a neutral line connection to the neutral bars 342.

As shown in FIG. 3A through FIG. 3C, there may be one or more pigtail guide channel 338 per stab 335. As depicted, pigtail guide channels 338 may be provided on both the right side 314R and the left side 314L of the base pan 314. Further, some of the pigtail guide channels 338 may be formed laterally in line with (aligned with) the stabs 335 formed on one of the busses 334, 336. Lateral direction is indicated by arrow 344. For example, there are ten stabs 335 shown on this base pan 314 and ten corresponding pigtail guide channels 338 on each side. However, other sizes (larger or smaller) of the base pan 314 and numbers of stabs 335 may be provided.

Figure 3D:
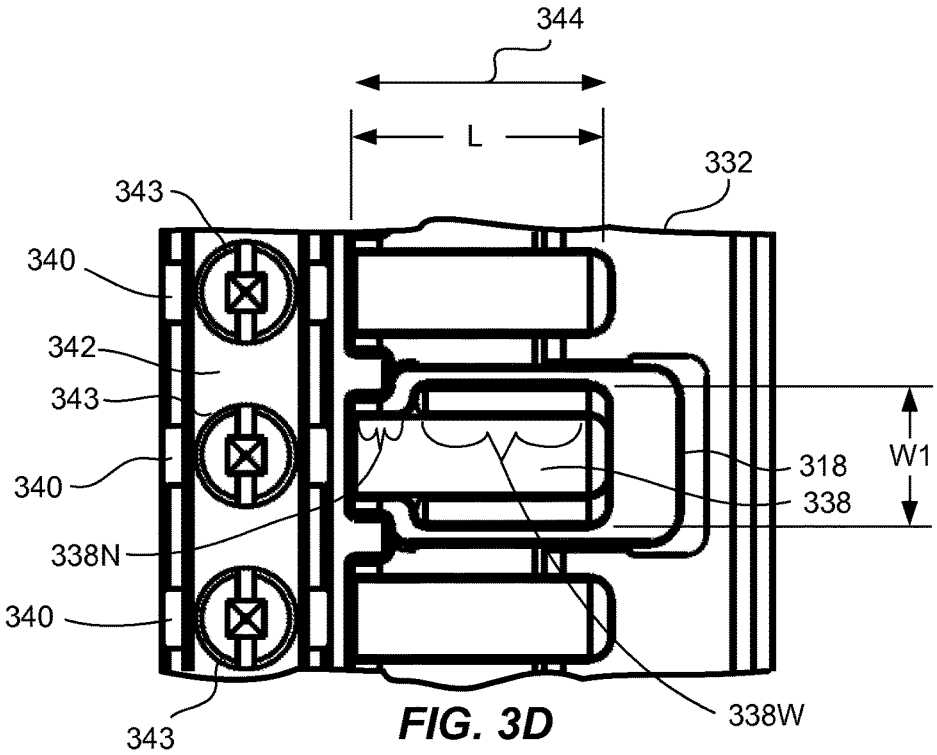
FIG. 3D illustrates an enlarged plan view of a portion of a base pan of FIG. 3A according to one or more embodiments.

As best shown in FIG. 3D, some of the pigtail guide channels 338 in the insulating base portion 332 may be formed laterally in line with a complementary feature 318, such as a hook, formed in the insulating base portion 332. Complementary feature 318 (e.g., hook) is configured and adapted to receive a connection feature 216 (e.g., a tab or other protuberance) formed on the circuit breakers 200, 200A to properly position and lock the load side 202B the circuit breakers 200, 200A on the base pan 314.

Figure 3E:
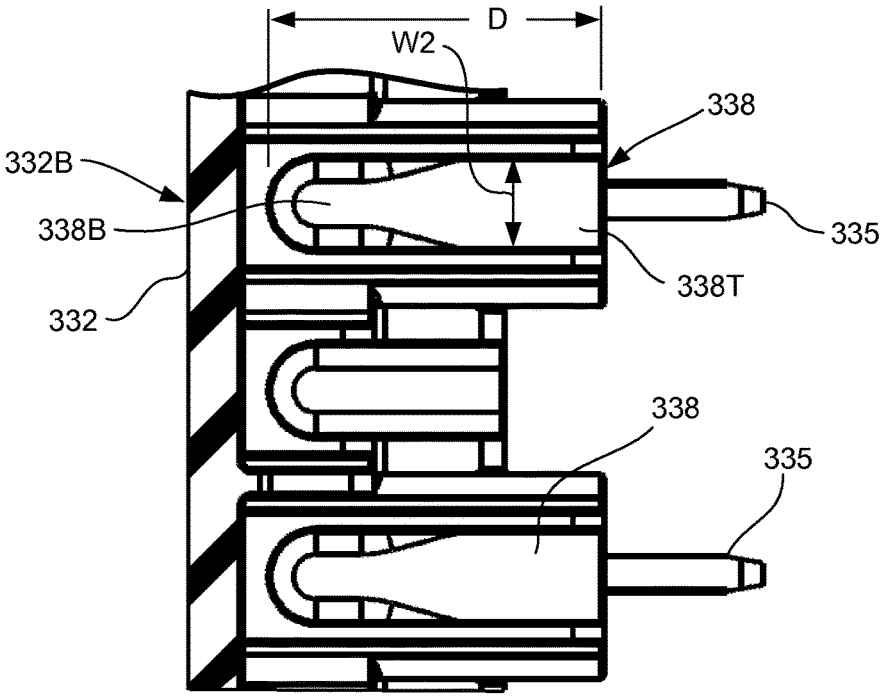
FIG. 3E illustrates an enlarged cross-sectioned side view of a portion of base pan of FIG. 3B according to one or more embodiments.

In one or more embodiments, and as shown in FIG. 3D, some of the pigtail guide channels 338 may include a first wider portion 338W and a second narrower portion 338N that is positioned laterally closer to the neutral bar 342. For example, the first wider portion 338W may have a first width W1 of between about 1 cm and about 1.5 cm. The narrower portion 338N may have a second width W2 measured perpendicular to the lateral length L and between opposing sides of the pigtail guide channel 338 and at a narrowest portion of the pigtail guide channel 338, as shown in FIG. 3E. Second width W2 may be less than about 0.5 cm, and between about 0.5 cm and about 1 cm in some embodiments. Other widths for first width W1 and second width W2 may be used.

As best shown in FIG. 3E, the pigtail guide channel 338 may include a top portion 338T and a bottom portion 338B closer to a base pan bottom 332B of the insulating base portion 332. The bottom portion 338B may be narrower than the top portion 338T. This configuration is beneficial even if the first width W1 is equal to the second width W2, because the top portion 338T being wider allows for easy insertion of the short wired pigtail 204 during installation, and the bottom portion 338B having a narrower width allows for precise alignment and directing of the short wired pigtail 204 with and to the associated neutral bar socket 340.

The pigtail guide channel 338 may be laterally aligned with a neutral bar socket 340 of the neutral bar 342 as shown in FIG. 3D. Likewise, as is best shown in FIG. 3F, the bottom of the bottom portion 338B may be laterally aligned with a bottom of the neutral bar socket 340. This further aids in directing the insertion of the terminal end 204E of the short wired pigtail 204 into the neutral bar socket 340 of the neutral bar 342 during installation as shown in FIG. 4. In one or more embodiments, a plurality of pigtail guide channels 338 may be provided, each being laterally aligned with a respective neutral bar socket 340 of the neutral bar 342.

In one or more embodiments, the pigtail guide channel 338 may have a lateral length L, as shown in FIG. 3D, of between about 1.5 cm and about 2.5 cm, and, as shown in FIG. 3E, a depth D from the top to the bottom of between about 2 cm and about 3 cm.

FIG. 4 illustrates a side view of a circuit breaker and base pan assembly 400. Circuit breaker and base pan assembly 400 includes a circuit breaker 200, 200A including a housing 202, and a short wired pigtail 204 exiting the housing 202, the short wired pigtail 204 having a factory length from a point of exit from the housing 202 to a terminal end 104E of less than about 16 cm. Circuit breaker and base pan assembly 400 further includes a base pan 314, including a plurality of busses 334, 336 (FIG. 3A), a neutral bar 342 including a neutral bar socket 340, and an insulating base portion 332 receiving the busses 334, 336, the base pan 314 configured to receive the circuit breaker 200, 200A, the insulating base portion 332 including a pigtail guide channel 338 adapted to direct the short wired pigtail 204 towards a neutral bar socket 340 as the circuit breaker 200 is mounted to the insulating base portion 332. Mounting may be accomplished by engaging the connection feature 216 to the complementary feature 318 at an angle and then rocking the circuit breaker 200, 200A clockwise onto the stab 335 (shown dotted). This action inserts the short wired pigtail 204 into the neutral bar socket 340.

Figure 5:
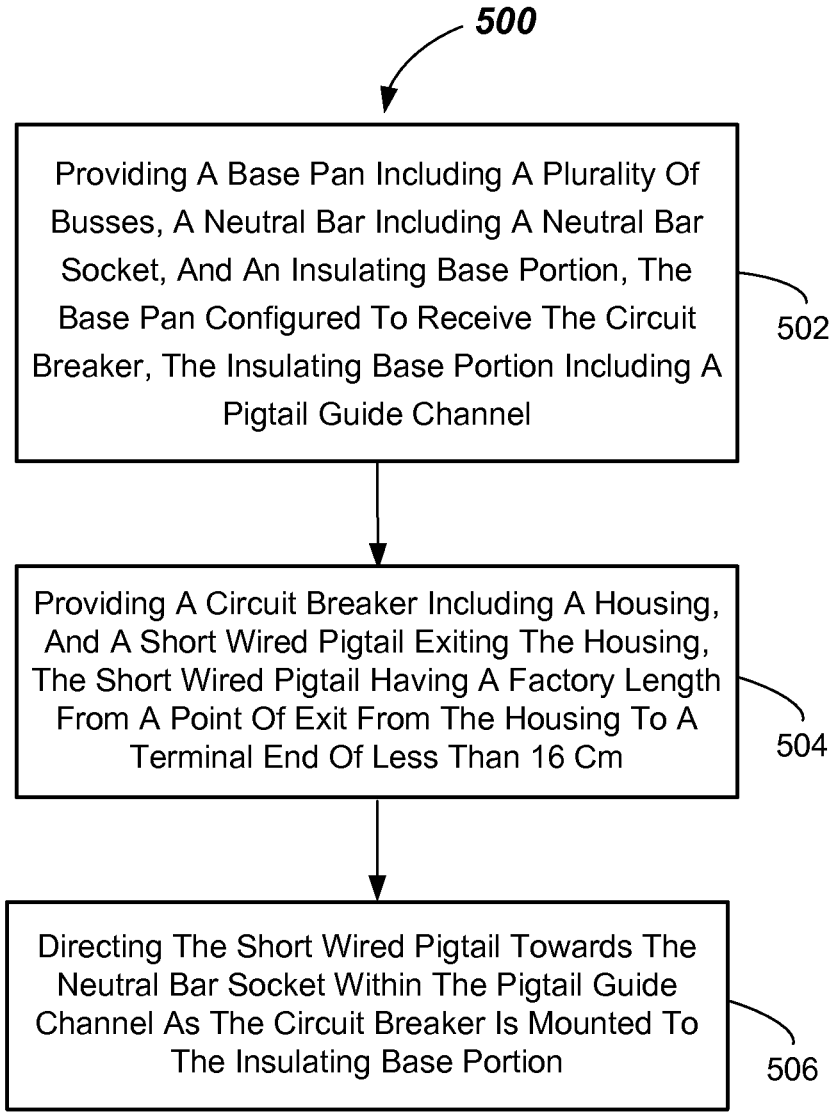
FIG. 5 illustrates a flowchart of a method of installing an electronic circuit breaker according to one or more embodiments.

According to another aspect, a method of installing a circuit breaker (e.g., circuit breaker 200, 200A) is provided. As shown in FIG. 5, the method 500 includes, in 502, providing a base pan (e.g., base pan 314) including a plurality of busses (e.g., busses 334, 336), a neutral bar (e.g., neutral bar 342) including a neutral bar socket (e.g., neutral bar socket 340), and an insulating base portion (e.g., insulating base portion 332), the base pan configured to receive the circuit breaker, the insulating base portion including a pigtail guide channel (e.g., pigtail guide channel 338).

The method 500 includes, in 504, providing a circuit breaker including a housing (e.g., housing 202), and a short wired pigtail (e.g., short wired pigtail 204) exiting the housing, the short wired pigtail having a factory length (measured along the central axis of the wire) from a point of exit from the housing to a terminal end (e.g., terminal end 204E) of less than about 16 cm.

The method 500 includes, in 506, directing the short wired pigtail towards the neutral bar socket within the pigtail guide channel as the circuit breaker is mounted to the insulating base portion. Thus, the steps of unwinding, measuring, and cutting formerly carried out by the installer may be reduced or eliminated. In some embodiments, the step of stripping and/or bending may also be eliminated. Thus, installation time and cost may be reduced.

While the invention is susceptible to various modifications and alternative forms, specific embodiments and methods thereof have been shown by way of example in the drawings and are described in detail herein. It should be understood, however, that it is not intended to limit the invention to the particular apparatus, assemblies, or methods disclosed, but, to the contrary, the intention is to cover all modifications, equivalents and alternatives falling within the scope of the invention.

What is claimed is:

1. A circuit breaker, comprising:

a housing; and a short wired pigtail exiting the housing, the short wired pigtail having a factory length from a point to exit from the housing to a terminal end of less than about 16 cm, wherein the housing includes a connection feature formed on the circuit breaker to interface with a complementary feature formed on a base pan having a insulating base portion, wherein the insulating base portion including a pigtail guide channel configured to direct the short wired pigtail towards a neutral bar socket as the circuit breaker is mounted to the insulating base portion, wherein the insulating base portion may be formed laterally in line with the complementary feature, wherein the complementary feature is configured and adapted to receive the connection feature to position and lock the circuit breaker on the base pan, and wherein mounting is accomplished by engaging the connection feature to the complementary feature at an angle and then rocking the circuit breaker clockwise onto a stab to insert the short wired pigtail into the neutral bar socket.

2. The circuit breaker of claim 1, wherein the factory length of is between about 5 cm and about 16 cm.

3. The circuit breaker of claim 1, wherein the short wired pigtail is pre-stripped from the factory.

4. The circuit breaker of claim 1, wherein the short wired pigtail includes an L-bend from the factory.

5. The circuit breaker of claim 4, wherein the L-bend is between about 60° to about 120°.

6. The circuit breaker of claim 1, comprising a starting bend towards a top of the circuit breaker as the short wired pigtail exits the housing.

7. The circuit breaker of claim 1, wherein the short wired pigtail comprises a first segment having a first length of between about 3 cm and about 10 cm, an L-bend, and a second segment having a second length between about 3 cm and about 10 cm.

8. A circuit breaker and base pan assembly, comprising:

a circuit breaker including:

a housing includes a connection feature formed on the circuit breaker, and a short wired pigtail exiting the housing, the short wired pigtail having a factory length from a point of exit from the housing to a terminal end of less than about 16 cm; and a base pan includes a complementary feature formed on the base pan to interface with the connection feature, including:

a plurality of busses, a neutral bar including a neutral bar socket, and an insulating base portion receiving the busses, the base pan configured to receive the circuit breaker, the insulating base portion including a pigtail guide channel adapted to direct the short wired pigtail towards a neutral bar socket as the circuit breaker is mounted to the insulating base portion, wherein the complementary feature is configured and adapted to receive the connection feature to position and lock the circuit breaker on the base pan, and wherein mounting is accomplished by engaging the connection feature to the complementary feature at an angle and then rocking the circuit breaker clockwise onto a stab to insert the short wired pigtail into the neutral bar socket.

9. The circuit breaker and base pan assembly of claim 8, wherein the pigtail guide channel is formed laterally in line with a stab formed on one of the busses.

10. The circuit breaker and base pan assembly of claim 8, wherein the pigtail guide channel is formed laterally in line with a hook formed in the insulating base portion, the hook adapted to receive a tab of the circuit breaker.

11. The circuit breaker and base pan assembly of claim 8, wherein the pigtail guide channel includes a first wider portion and a second narrower portion closer to the neutral bar.

12. The circuit breaker and base pan assembly of claim 8, wherein the pigtail guide channel includes a wider top portion and a narrower bottom portion closer to a bottom of the insulating base portion.

13. The circuit breaker and base pan assembly of claim 12, wherein a bottom of the narrower bottom portion is laterally aligned with a bottom of the neutral bar socket.

14. The circuit breaker and base pan assembly of claim 8, wherein the pigtail guide channel includes a lateral length of between about 1.5 cm and about 2.5 cm.

15. The circuit breaker and base pan assembly of claim 8, wherein the insulating base portion includes the neutral bar mounted thereto.

16. The circuit breaker and base pan assembly of claim 15, wherein the pigtail guide channel is laterally aligned with the neutral bar socket of the neutral bar.

17. The circuit breaker and base pan assembly of claim 15, comprising a plurality of pigtail guide channels each being laterally aligned with the neutral bar socket of the neutral bar.

18. The circuit breaker and base pan assembly of claim 8, wherein the pigtail guide channel includes a channel width measured perpendicular to a lateral length and between opposing sides of the pigtail guide channel, and at a narrowest portion of the pigtail guide channel, of less than about 0.5 cm.

19. A method of installing a circuit breaker, comprising:

providing a base pan including a plurality of busses, a neutral bar including a neutral bar socket, and an insulating base portion, the base pan configured to receive the circuit breaker, the insulating base portion including a pigtail guide channel;

providing a circuit breaker including a housing, and a short wired pigtail exiting the housing, the short wired pigtail having a factory length from a point of exit from the housing to a terminal end of less than about 16 cm; and directing the short wired pigtail towards the neutral bar socket within the pigtail guide channel as the circuit breaker is mounted to the insulating base portion, wherein the housing includes a connection feature formed on the circuit breaker, wherein the base pan includes a complementary feature formed on the base pan to interface with the connection feature, wherein the complementary feature is configured and adapted to receive the connection feature to position and lock the circuit breaker on the base pan, and wherein mounting is accomplished by engaging the connection feature to the complementary feature at an angle and then rocking the circuit breaker clockwise onto a stab to insert the short wired pigtail into the neutral bar socket.

* * * * *